US005709108A

United States Patent [19]

Ono et al.

[11] Patent Number: 5,709,108

[45] Date of Patent: Jan. 20, 1998

[54] AUXILIARY DRIVING DEVICE AND CONTROL METHOD FOR PATTERNING DEVICE IN WARP KNITTING MACHINE

[75] Inventors: Kotaro Ono; Yoshinori Otobe, both of Fukui, Japan

[73] Assignee: Nippon Mayer Co., Ltd., Fukui, Japan

[21] Appl. No.: 647,984

[22] PCT Filed: Oct. 18, 1995

[86] PCT No.: PCT/JP95/02137

§ 371 Date: Jul. 24, 1996

§ 102(e) Date: Jul. 24, 1996

[87] PCT Pub. No.: WO96/12841

PCT Pub. Date: May 2, 1996

[30] Foreign Application Priority Data

Oct. 19, 1994 [JP] Japan ..... 6-253255
Nov. 24, 1994 [JP] Japan ..... 6-288516

[51] Int. Cl.[6] ..... D04B 27/26

[52] U.S. Cl. ..... 66/205

[58] Field of Search ..... 66/205, 206, 207

[56] References Cited

U.S. PATENT DOCUMENTS 3,478,543 11/1969 Faninger ..... 66/205
3,678,711 7/1972 Schneider et al. ..... 66/205
3,729,954 5/1973 Ducol ..... 66/205
3,978,690 9/1976 Beling et al. ..... 66/205
4,051,698 10/1977 Leohnardt ..... 66/205
5,259,216 11/1993 Zorini ..... 66/205 X
5,327,750 7/1994 Speich ..... 66/205 X

*Primary Examiner*—John J. Calvert
*Attorney, Agent, or Firm*—Jordan and Hamburg

[57] ABSTRACT

The present invention relates to an auxiliary driving device for the patterning device for a warp knitting machine, including a desired number of movable bodies each having at least a portion thereof formed as a guide point, the movable bodies being disposed in a guide path so that they are movable on the basis of driving means installed thereon, patterning being effected in that the individual guide points are moved by desired amounts of displacement in optional directions on the basis of signals transmitted from an electronic control section to the driving means for the individual movable bodies and are thereby positioned. The invention provides a device and method enabling the movement of the movable body to follow even a high speed rotation, and is characterized in that it includes auxiliary driving means for adding to the driving force from the driving means during start and movement involved in the lapping caused by the movable body. For example, the blowing of compressed air is used and the force with which the compressed air blows through a nozzle which is installed in a portion of the movable body is utilized or the compressed air is blown through a nozzle directed to the movable body. Further, signals, e.g., pulse signals, to the movable body are on a one pulse one gauge pitch basis, thereby ensuring that the position at which the movable body is stopped between adjacent knitting needles.

10 Claims, 8 Drawing Sheets

AUXILIARY DRIVING DEVICE AND CONTROL METHOD FOR PATTERNING DEVICE IN WARP KNITTING MACHINE

TECHNICAL FIELD

The present invention relates to an auxiliary driving device and a control method for a patterning device in a warp knitting machine.

BACKGROUND ART

Heretofore, the patterning in a warp knitting machine has been effected by allowing a pattern guide bar having guide points mounted thereon to effect lapping movement in the direction of rows of knitting needles by means of pattern guide bar lapping means such as a chain drum or electronic patterning device or in the case of a float pattern guide bar for forming float patterns it is reciprocated with a fall plate attached thereto. However, since the amount of lapping obtainable is the same for all guide points mounted on a single row of pattern guide bars, the resulting patterning effect, which is influenced by the number of pattern guide bars, is nothing but one which is proportional to the number of pattern guide bars.

In view of the above problem, the present applicant previously proposed a new patterning device in Japanese Patent Application No. 6-200750. According to this device, the guide points and/or fall plate is installed as a portion of a movable body in a fixed guide path corresponding to a pattern guide and is adapted to move in said guide path. As an embodiment of such device, the guide path side is constructed as a stator for a linear motor, while movable body including the guide points and/or fall plate is constructed as a movable body for the linear motor.

Further, in the conventional warp knitting machine having fall plates, the so-called fall plate knitting is effected wherein float pattern yarns guided by a float pattern guide bar are moved in that the fall plate is actuated from the stitch forming position of knitting needles to a non-stitch forming position. In this connection it is to be noted that the fall plate has been formed of a single plate so as to act on the entire row of knitting needles.

In the aforesaid proposed patterning device, the movable body at least a portion of which forms a guide point is displaced for each knitting course by an amount corresponding to the knitting machine gauge on the basis of pulse signals from an electronic control section; thus, the movable body is required to have a higher followability as the rotation number of the knitting machine increases. However, during high speed movement of the knitting machine, the starting-up movement of the movable body inevitably tends to delay because of the characteristics of a linear motor, which delay forms a cause of obstructing an increase in the rotation number of the knitting machine.

Further, there has been the fear of causing serious damage to knitting components; if the front end of the guide point which integrally moves with displacement and stoppage of the movable body act at a position where it comes into contact or collide with the knitting needles owing to erroneous transmission of pulses, then, at the worst, for example, yarn or needle breakage occurs.

Further, in a warp knitting machine having the aforesaid latter fall plate, the fall plate is constructed to simultaneously acts over the entire knitting machine width. Therefore, even in the case of simultaneously knitting a plurality of fabrics, where there are a plurality of knitting widths, with the pattern arrangement differing for each width, such as one having a sink pattern alone or a partial float pattern, the fall plate acts for each course, with the result that the vibration of the knitting machine is accelerated while large-scale devices such as cams and levers are required.

An object of the present invention is to provide an auxiliary driving device which eliminates the drawbacks in said patterning device and which is capable of sufficiently following a high speed rotation, and control method which ensures reliable action taking place between knitting needles even at the time of displacement or stoppage of the movable body owing to erroneous transmission of pulses.

Another object of the invention is to provide a warp knitting machine which eliminates the drawbacks of a conventional warp knitting machine having fall plates and in which the fall plate action can be effected for each knitting width and can be selectively used for necessary courses.

DISCLOSURE OF THE INVENTION

The present invention provides an auxiliary driving device for the patterning device for a warp knitting machine, including a desired number of movable bodies each having at least a portion thereof formed as a guide point, said movable bodies being disposed in a guide path so that they are movable on the basis of driving means directly or associatively installed thereon, patterning being effected in that the respective guide points are moved amounts of displacement in desired directions on the basis of signals transmitted from an electronic control section to the driving means for the individual movable bodies and are thereby positioned, said auxiliary driving device is characterized in that auxiliary driving means is attached to the movable body which adds to the driving force from the driving means during start and movement involved in the lapping by the movable bodies.

According to this device, in displacing the movable body at least a portion of which constitutes a guide point, the movable body can be quickly displaced by compensating for the delay in the starting movement of the movable body, so that smooth displacement of the movable body is ensured even in high speed movement.

If the auxiliary driving means is embodied in the form of compressed air blown from a nozzle installed on a portion of the movable body, the direction of blow can be easily controlled by employing two directions of blow and switching from one to another.

If the auxiliary driving means is embodied in the form of compressed air blown from a nozzle directed to the movable body, it becomes unnecessary to provide the movable body with an extra air conveying tube, so that even if the number of movable bodies is increased, the movement of the movable bodies can be smoothly effected.

If the auxiliary driving means is embodied in the form of a magnetic arrangement, the instantaneous starting action becomes more effective.

If the magnetic arrangement comprises a combination of the stator of a linear motor and the movable body, this is advantageous in terms of control when the driving means for the movable body is a linear motor.

If the magnetic arrangement comprises the attraction and/or repellence of iron cores constituting electromagnets, the construction is simple and the weight of the movable body can be decreased.

If a piezoelectric element is utilized as the auxiliary driving means, the auxiliary driving device can also be satisfactorily constructed.

The present invention also provides a warp knitting machine comprising movable bodies at least portions of which constitute divisional fall plates are disposed such that they can fall on the basis of driving means directly or associatively installed thereon, the patterning being effected in that the action of the individual fall plates selectively takes place on the basis of signals transmitted from an electronic control section to the driving means for the individual movable bodies.

The aforesaid warp knitting machine is characterized in that it has attached thereto auxiliary driving means for adding to the driving force from the driving means during start and movement involved in the fall action of the movable body. This compensates for the delay in the movement of the fall plate.

Further, according to the present invention, in the control method for effecting patterning by sending pulse signals to the patterning device described above, the amount of stepping movement of the pulse motor is set in such a manner as to ensure that the front end of the guide point in the movable body to be moved by pulses is positioned between adjacent knitting needles; preferably the amount of stepping movement is set to one pitch of the knitting needle gauge.

Thereby, in the case of displacing the movable body by pulse signals, it is ensured that the guide point acts between adjacent knitting needles even if an intended number of pulses are not correctly transferred to the movable body owing to machine trouble or the like; therefore, no needle or yarn breakage will occur.

Further, according to the present invention, in the patterning device for a warp knitting machine, including a desired number of movable bodies each having at least a portion thereof formed as a guide point, said movable bodies being disposed in a guide path so that they are movable on the basis of driving means, patterning being effected in that the respective guide points are moved by desired amounts of displacement in desired directions on the basis of signals transmitted from an electronic control section to the driving means for the individual movable bodies and are thereby positioned, two or more knitting machine gauges are provided and the amounts of displacement are set for the individual movable bodies with the individual knitting gauge pitches used as criteria.

For example, by making arrangements for the movable body to be displaced on the basis of pulse signals and for said pulse signals to correspond to the amounts of stepping movement of the individual movable bodies matching the individual knitting gauges, it is possible to simultaneously produce warp knitted fabrics having pattern arrangements differing for different knitting gauges.

In the warp knitting machine of the present invention, the movable bodies at least portions of which constitute divisional fall plates are disposed such that they can fall on the basis of driving means directly or associatively installed thereon, the patterning being effected in that the action of the individual fall plates selectively takes place on the basis of signals transmitted from an electronic control section to the driving means for the individual movable bodies. Preferably, the guide path is defined by the stator of the linear motor and the divisional fall plates are designed to be movable bodies, thereby making it possible to selectively actuate fall plates which lie at necessary positions in a desired knitting course.

BEST MODE FOR EMBODYING THE INVENTION

Figure 1:
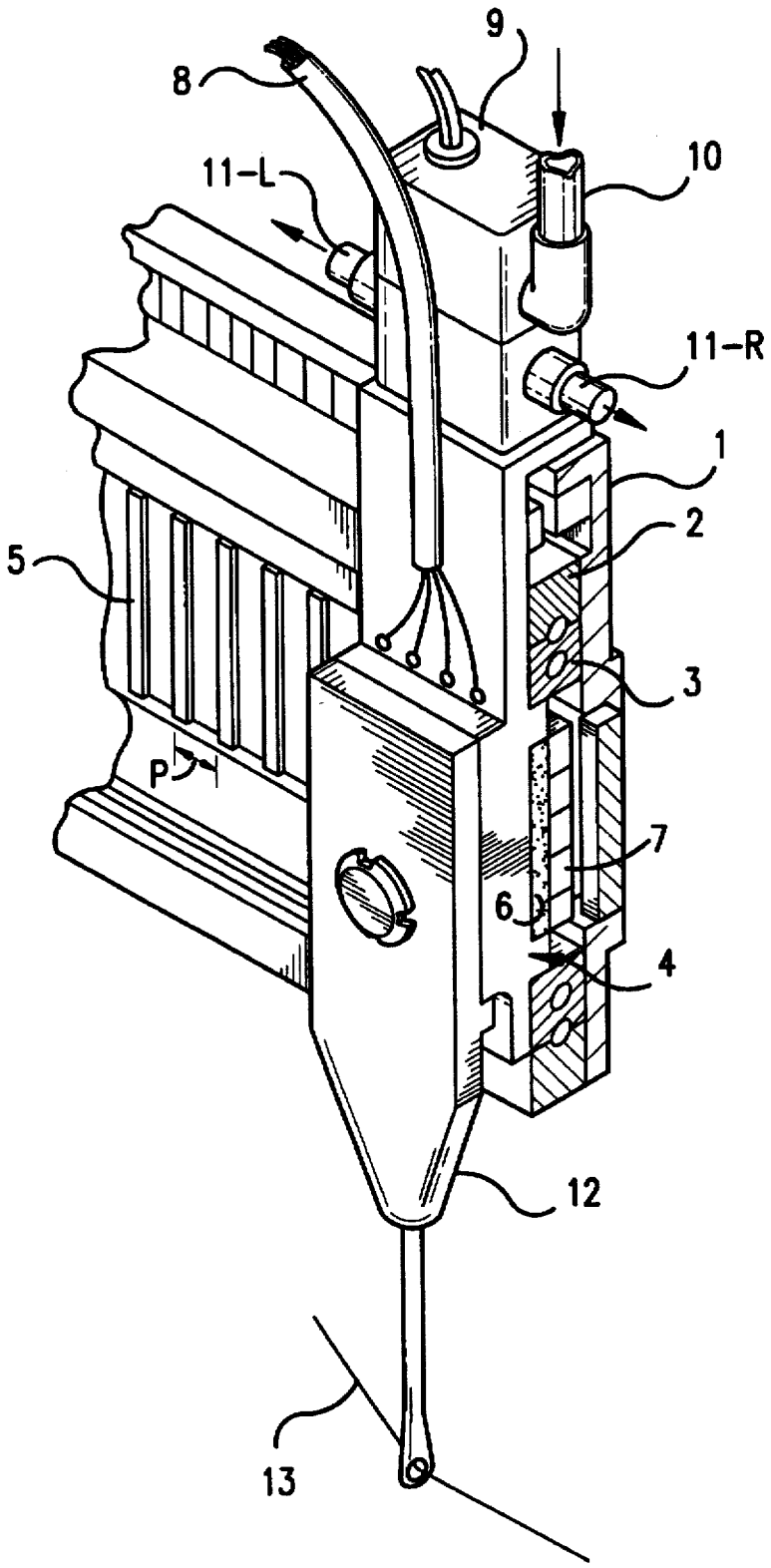
FIG. 1 is a perspective view showing an embodiment of the auxiliary driving device of the invention.

FIG. 1 is a perspective view, partly in section, showing an embodiment of the present inventive device. The numeral denotes a holding member and 2 denotes a pair of linear guides extending parallel and attached to said holding member 1, with a pair of slide bearings 3 movably installed therebetween. Further, a movable body 4 is fixed to said pair of slide bearings 3, so that the movable body 4 is capable of moving with slight resistance in parallel with the holding member 1.

The holding member 1 has fixed thereto a tooth-shaped plate-like iron core of high permeability, i.e. a tooth-shaped iron core 5, the tooth pitch being designated by P. On the other hand, the movable body 4 is provided with permanent magnets 6 and electromagnets 7, one side of said electromagnets 7 maintaining a gap of 20–50 μm between them and the raised surface of the tooth-shaped iron core 5. In this way, the tooth-shaped iron core 5 and the permanent magnets 6 and electromagnets 7 constitute a linear pulse motor. Passage of pulse current to the electromagnets 7 is effected by a cord 8. The movable body is moved by one step for each pulse which one step corresponds to ¼ of the tooth pitch P. If the knitting machine gauge of the warp knitting machine is 24 per inch, and if the pitch P is 4.23 mm, then the movable body 4 moves by one gauge for each pulse current. Since the movable body 4 has a guide point 12 attached thereto, the pattern yarn 13 is moved by one gauge. As for the electromagnets 7 on the movable body, at least two such electromagnets are required and depending upon the gauge, four or more may be provided.

On the other hand, when a pulse linear motor is used with a warp knitting machine, starting sometimes becomes unstable under the influence of the working environment and vibration. For this reason, in the present invention, auxiliary driving means is attached to the movable body. In this embodiment, as such auxiliary means, as shown in FIG. 1, there is employed means for instantaneously blowing compressed air to assist in starting operation. That is, a solenoid switching valve 9 is installed on one end of the movable body 4, and compressed air is fed into the valve 9 by a pipe 10. Thus, the compressed air is instantaneously spouted from a nozzle 11-R which faces for a direction opposite to the direction in which the movable body is to be moved, e.g., the rightward direction in the figure, so that the movable body is moved by the force of reaction. As for the spouting time, spouting is required only at the time of starting operation, there being no need to continue spouting.

Figure 2:
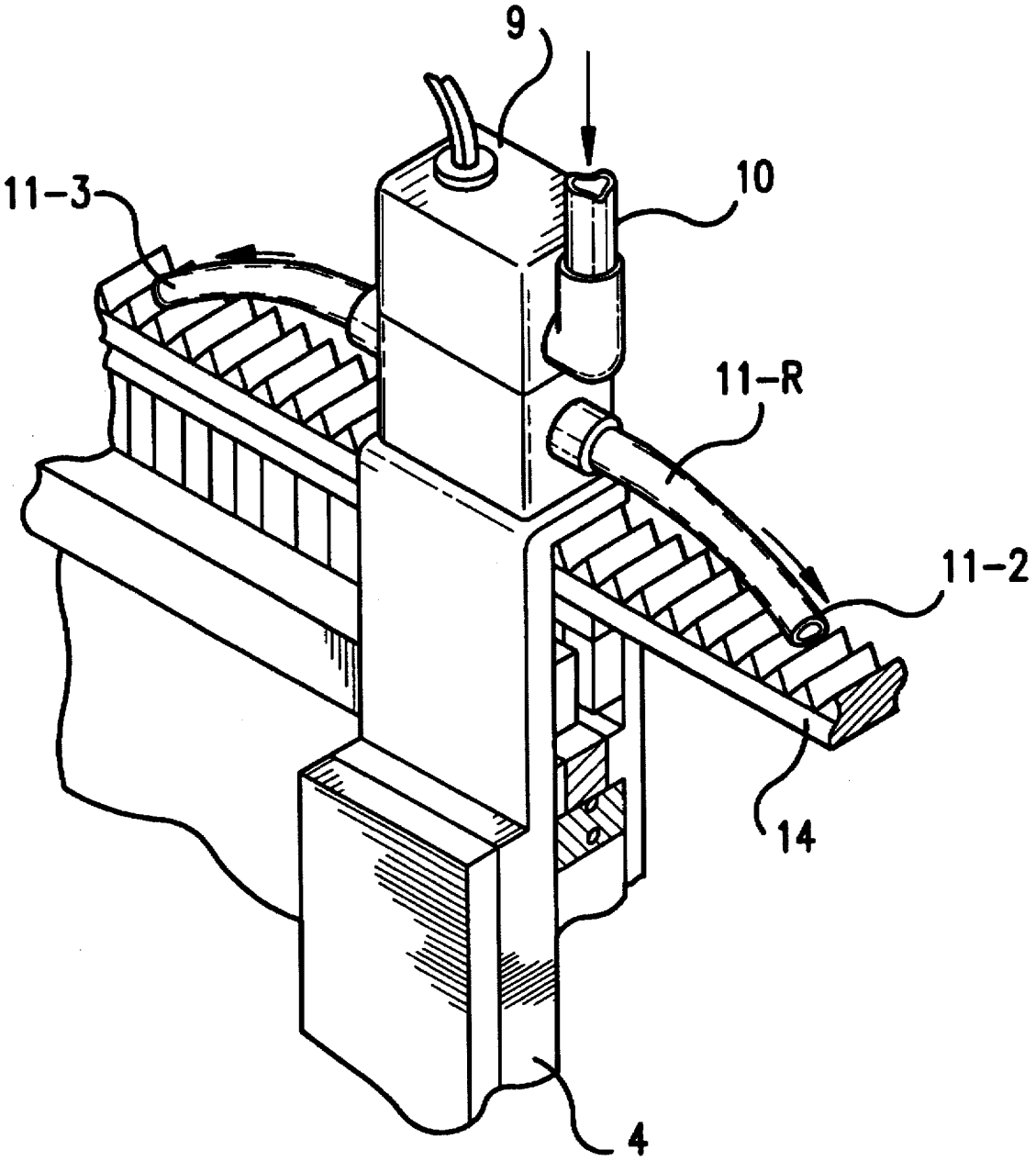
FIG. 2 is a fragmentary perspective view showing another embodiment of the auxiliary driving device of the invention.

FIG. 2 is a perspective view showing means for more effectively taking out the force of reaction to the spouting of compressed air. That is, a sawtooth rail 14 is installed in parallel with the direction of travel of the movable body 4, and the front end 11-2 of the nozzle 11-R is oriented to blow compressed air to obliquely dash against the upper surface of the sawtooth rail 14. The sawtooth pitch of the sawtooth rail 14 is equal to the knitting machine gauge of the warp knitting machine, whereby the force of reaction is maintained constant.

Further, in said auxiliary driving device, the movable body 4 is moved by one step for each pulse which one step is ¼ of the tooth pitch P. If the knitting machine gauge of the warp knitting machine is 24 per inch and the pitch P is 4.23 mm, then it follows that the movable body 4 moves by one gauge-for each pulse current. Since the movable body 4 has the guide point 12 attached thereto, the pattern yarn 13 moves by one gauge. As for the electromagnets on the movable body, at least two such electromagnets are required and depending upon the gauge, four or more may be provided. Thus, when the movable body is to be displaced by pulse signals, pulses are fed one by one to the pulse motor driver to produce a displacement of one pitch of knitting machine gauge. For example, if it is desired to produce a displacement of N gauges, control is effected to feed N pulses for each knitting course, whereby even if a predetermined number of pulses should not be fed to the motor in one knitting course, the movable body will come to a stop after having moved over a distance corresponding to an integer multiple of the number of transmitted pulses with respect to the pitch corresponding to the knitting machine gauge. Therefore, it is ensured that the guide point belonging to the movable body stops between knitting needles without fail. As a result, it is possible to prevent damage to the knitting needles due to the guide point colliding with them or breakage of pattern yarns due to the guide point coming into contact with them.

Figure 3:
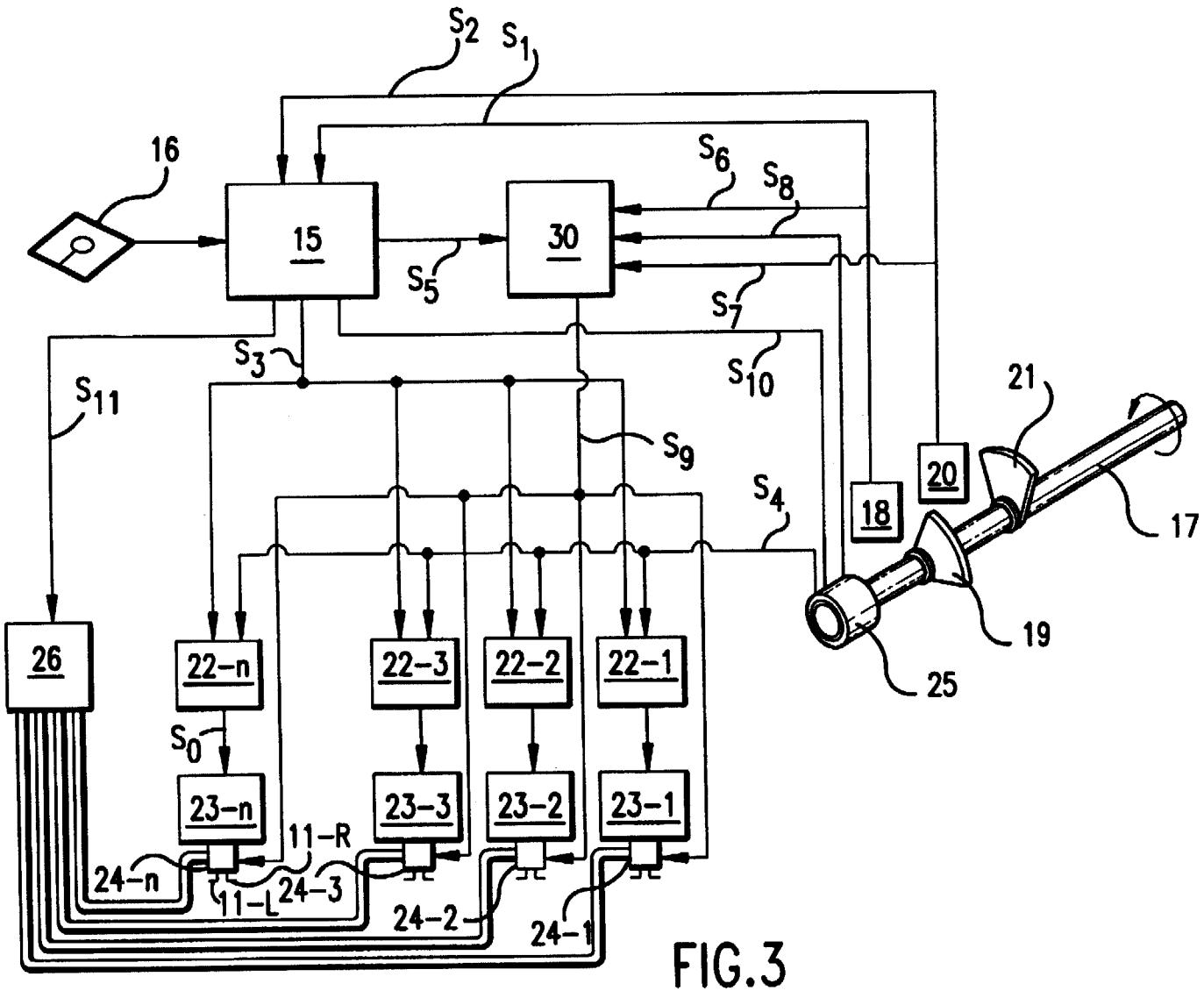
FIG. 3 is a block diagram showing an example of control of the auxiliary driving device of the invention.

An example of control in the embodied device of the invention will now be described with reference to FIG. 3. The numeral 15 denotes a computer unit for control. Pattern data 16 which is prepared in advance on the basis of the pattern arrangement of the lace is stored in the storage device of the computer unit 15. And periodic signals S1 and S2 are sent to the computer unit 15 from a combination of a proximity sensor 18 for transmitting underlap start signals and a disk 19 for said proximity sensor 18 and a combination of a proximity sensor 20 for transmitting overlap start signals and a disk 21 for said proximity sensor 20, said disks being mounted on a main shaft 17.

The reference characters 22-1, 22-2, 22-3 . . . 22-n denote linear pulse motor drivers; 23-1, 23-2, 23-3 . . . 23-n denote linear pulse motors; and 24-1, 24-2, 24-3 . . . 24-n denote solenoid switching valves, the latter being integrally connected together to constitute the movable body including the guide point. The numeral 25 denotes a rotary encoder mounted on the main shaft 17 for detecting the rotative speed of the knitting machine. The numeral 26 denotes an air compressor connected to the individual solenoid switching valves 24 through flexible tubes 27.

And the computer unit 15 simultaneously sends a plurality of control signals S3 to the individual linear motor driver 22 for controlling the direction of movement and the number of steps matching the amount of displacement based on the pattern arrangement. Further, the rotary encoder 25 sends signals S4 to the individual linear pulse motor drivers 22 for controlling the pulse transmission rate. And drive signals S0 are sent from the drivers 22 to the individual pulse motors 23 to allow the pulse motors to effect desired amounts of displacement.

On the other hand, a solenoid switching valve control unit 30 receives a signal S5 from the computer unit 15 to determine which of the nozzles 11-L and 11-R is to be fed with air, and also receives a signal S6 or S7 from the proximity sensor 18 or proximity sensor 20 for controlling the starting time of air spouting and a signal S8 from the rotary encoder 25 for controlling of the duration of the spouting. On the basis of these signals, the solenoid switching valve control unit transmits a signal S9 for controlling the opening/closing direction, time and duration of the valves 24.

As for the air pressure, a signal S11 for adjusting the pressure is transmitted from the computer unit 15 to an air compressor 26 on the basis of a signal S10 from the rotary encoder 25, and on the basis of this signal S11, compressed air is fed to the individual valves 24 through the tubes 27.

In the above embodiment, spouting compressed air from nozzles provided on a portion of the movable body adds to the driving force at the start and during movement of the movable body. However, in another embodiment, nozzles may be provided in a portion of the guide path for blowing compressed air against the individual movable bodies to add to the driving force for the movable bodies. According to this device, even if the number of movable bodies increases, there is no need for the movable bodies to move while producing noise, which is advantageous in knitting operation.

Further, the present invention enables guide points 12 to move separately over a predetermined length by means of electric control signals alone; thus, for example, when it is desired to knit three widths of 40-inch wide fabric in a warp knitting machine having a knitting width of 130 inches, the individual widths can be knit with different gauges. In a conventional warp knitting machine having pattern guide bars, a driving source is installed on one side of the machine to push and pull the guide bars to control the positions of the guide points attached thereto; therefore, guide bars which match the overall knitting width of the machine are required. If the same operation as in the present invention is to be performed by the conventional warp knitting machine, then for making three widths on a 130-inch knitting width, three times as many guide bars are required and three driving sources have to be prepared, a plan which must be said to be impossible from the standpoint of the construction of the warp knitting machine.

Figure 4:
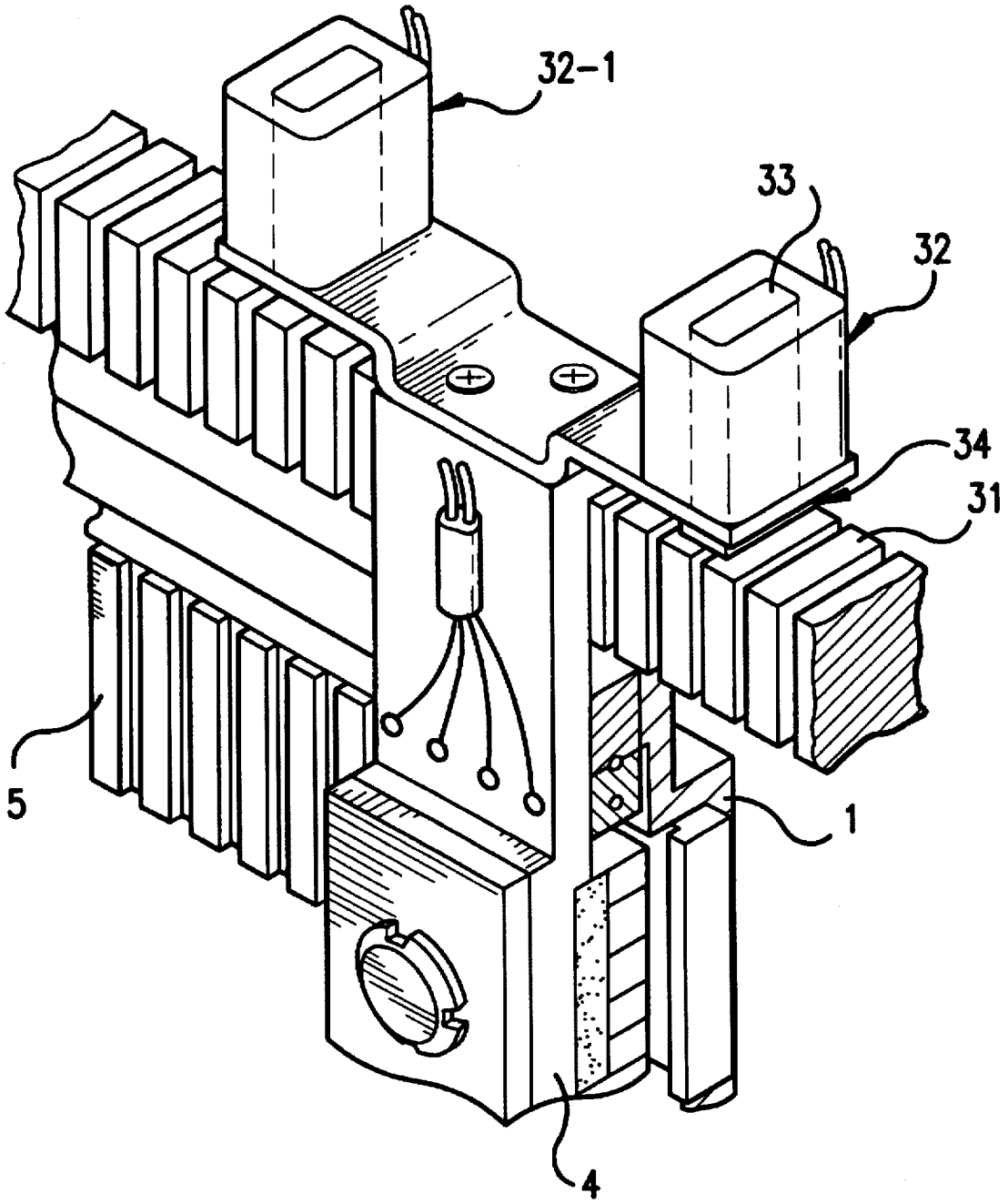
FIG. 4 is a fragmentary perspective view showing another embodiment of the auxiliary driving device of the invention.
Figure 5:
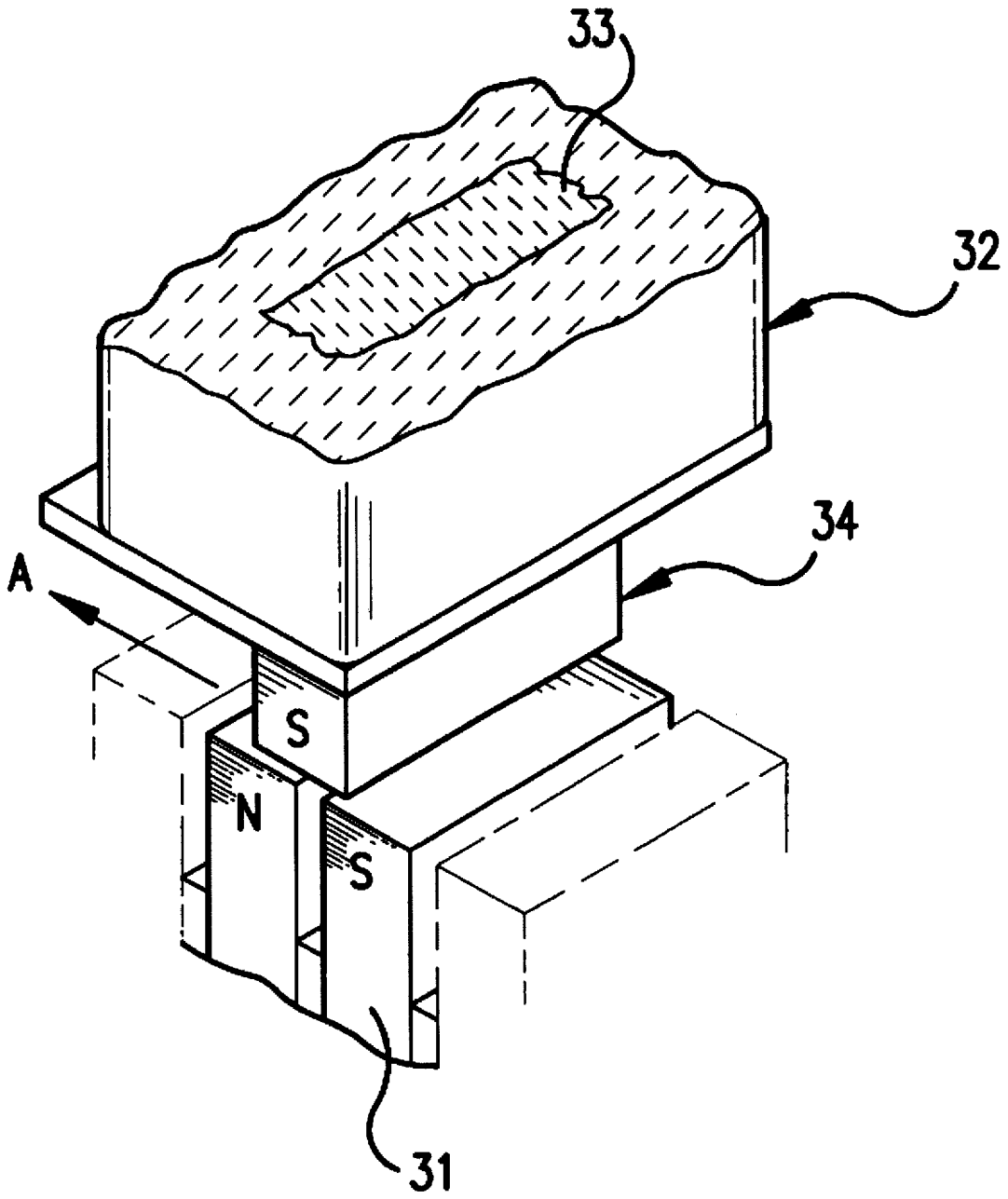
FIG. 5 is a fragmentary enlarged view of FIG. 4.

FIG. 4 shows an embodiment wherein permanent magnets 31 and electromagnets 32 are installed at one end of a movable body 4 to ensure the start of the movable body 4. The permanent magnets 31 are disposed on the upper surface of the holding member 1 such that the N and S poles alternate with each other with the same pitch as the gauge pitch of the knitting needles in parallel with the track of the movable body 4, with a given slight gap for movement defined between the upper surfaces of the permanent magnets 31 and the front ends 34 of the iron cores of the electromagnets at one of their respective sides. The movable body 4, which basically can be operated by the linear pulse motor shown in FIG. 1, is arranged such that in the stop position, the front ends 34 of the iron cores are positioned intermediate between the N and S poles of the permanent magnets. This situation is shown enlarged in FIG. 5. The situation of this stop position is also the same for the electromagnet 32-1. Instantaneously at the same time as a start signal is transmitted to the linear pulse motor, the electromagnets 32 and 32-1 are energized to magnetize the front ends 34 of the iron cores compatibly with the direction of travel of the movable body 4. For example, in the case where, in FIG. 5, magnetization is effected such that the front end 34 of the iron core assumes the S pole, it is moved in the direction of arrow A under the action of attraction and repellence of the magnets. These operations are intended precisely to impart an auxiliary thrust in starting the movable body 4.

Figure 6:
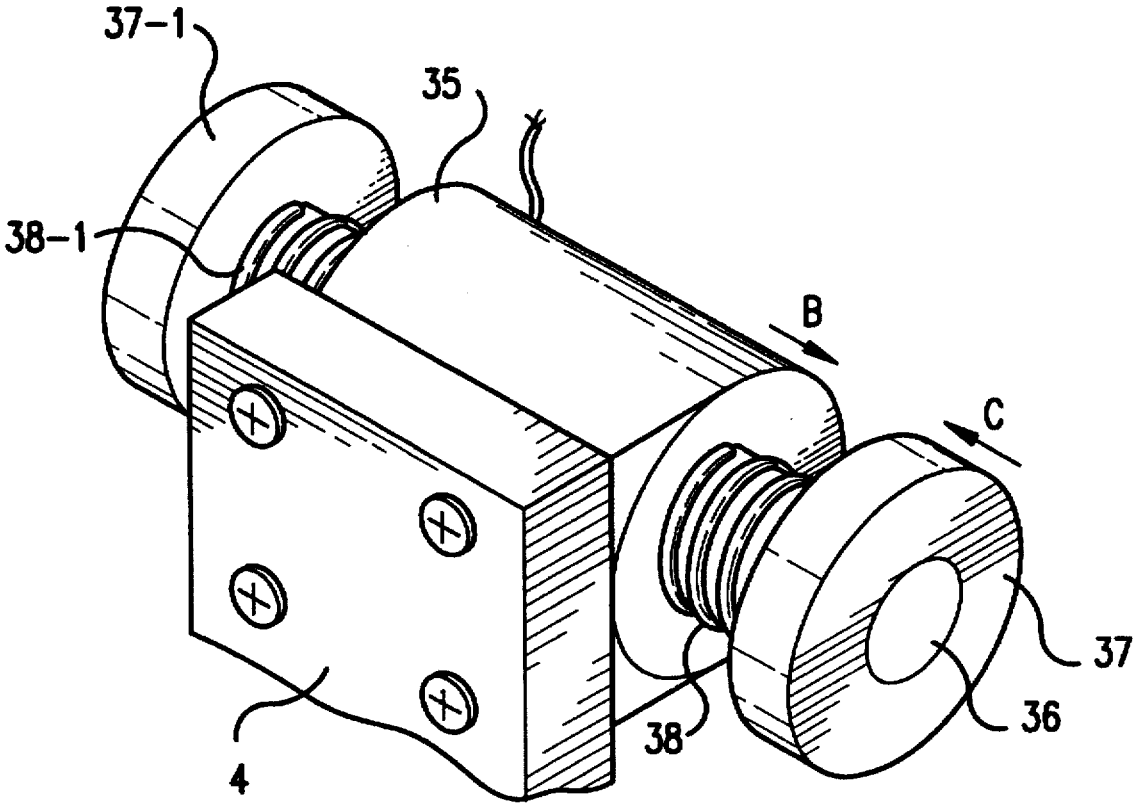
FIG. 6 is a fragmentary perspective view showing another embodiment of the auxiliary driving device of the invention.

FIG. 6 shows an embodiment for likewise ensuring the start of the movable body. An electromagnetic coil 35 is installed at one end of the movable body 3 and has attached thereto a magnetized iron core 36 movable centrally therethrough parallel with the direction of movement of the movable body, and flanges 37 and 37-1 fixed to the opposite ends of said iron core. Further, springs 38 and 38-1 are interposed between the flanges 37, 37-1 and one end of the electromagnetic coil 35 to prevent the flanges and the magnetic coil from approaching each other beyond a given distance. In operation, in the case where the electromagnetic coil 35 is instantaneously energized, for example, in the case where the electromagnetic coil 35 and flange 37 are to move toward each other in the directions of arrows B and C, the movable body 4 is driven in the direction of arrow B. If the polarity of energization is reversed, the magnetized iron core and flange are started in the directions opposite to the directions of arrows B and C. These individual motions are effected in a single motion system; therefore, though it does not follow that as a whole the movable body 4 is moved in a given direction over a predetermined distance, it is possible to instantaneously start the movable body 4 in accordance with the law of inertia.

Further, it is possible, as auxiliary driving means, to combine the displacement of a piezoelectric element with an elastic body to utilize the displacement thereof as an auxiliary thrust for the start or movement of the movable body; a suitable combination of levers and arms will produce smooth movement of the movable body.

Figure 7:
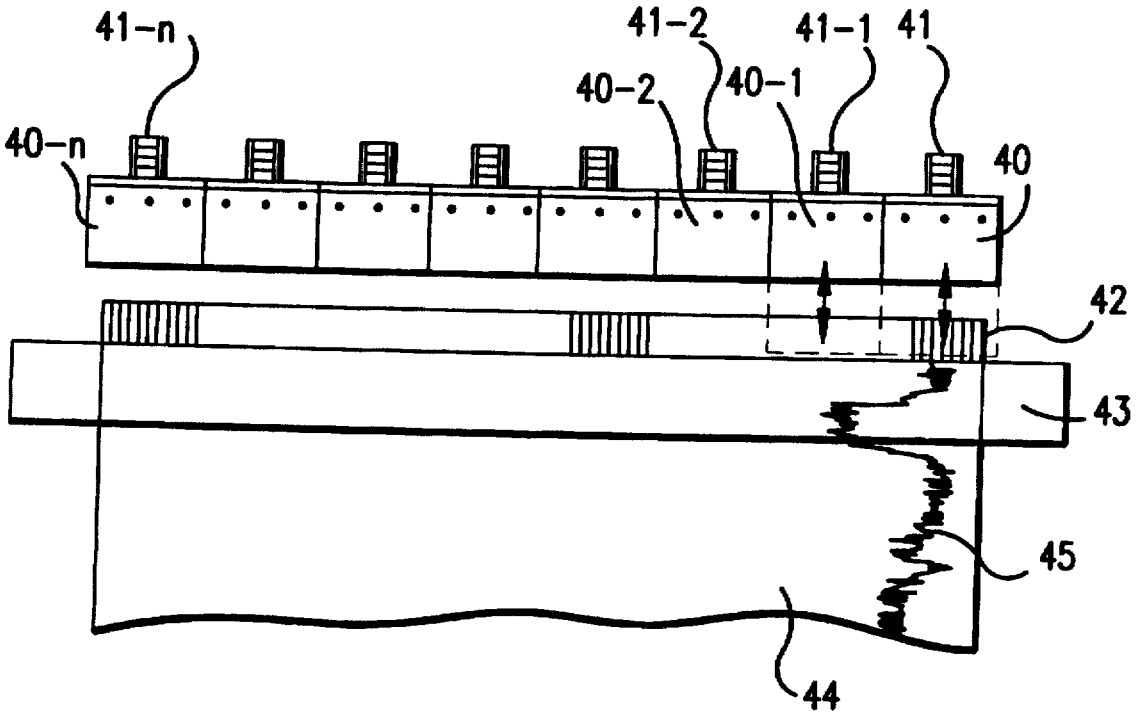
FIG. 7 is a front view showing the fall plate portion of a warp knitting machine of the invention.

FIG. 7 shows an example using a linear motor as a driving source for actuating a fall plate. The numeral 40 denotes a divisional fall plate, such being indicated by 40-1, 40-2 . . . 40-n. The divisional fall plates are provided with linear driving bodies 41, 41-1 . . . 41-n. The n fall plates are in the same plane and perform the fall plate action as they fall to the adequate position to act on a needle row 42. The numeral 43 denotes a trick plate. The width of the individual fall plates is about 2–10 inches, and the n fall plates can be selectively actuated. In the case where a pattern yarn 45 to provide a design on a knitted fabric 44 being produced is to be fixed on the knitted fabric as a float pattern, the fall plates 40 and 40-1 may be suitably actuated, there being no need to actuate 40-2 . . . 40-n. Thus, without requiring a conventional large-scale machine designed to actuate a single fall plate over the entire knitting width, the fall plate operation can be performed using a simple device.

Figure 8:
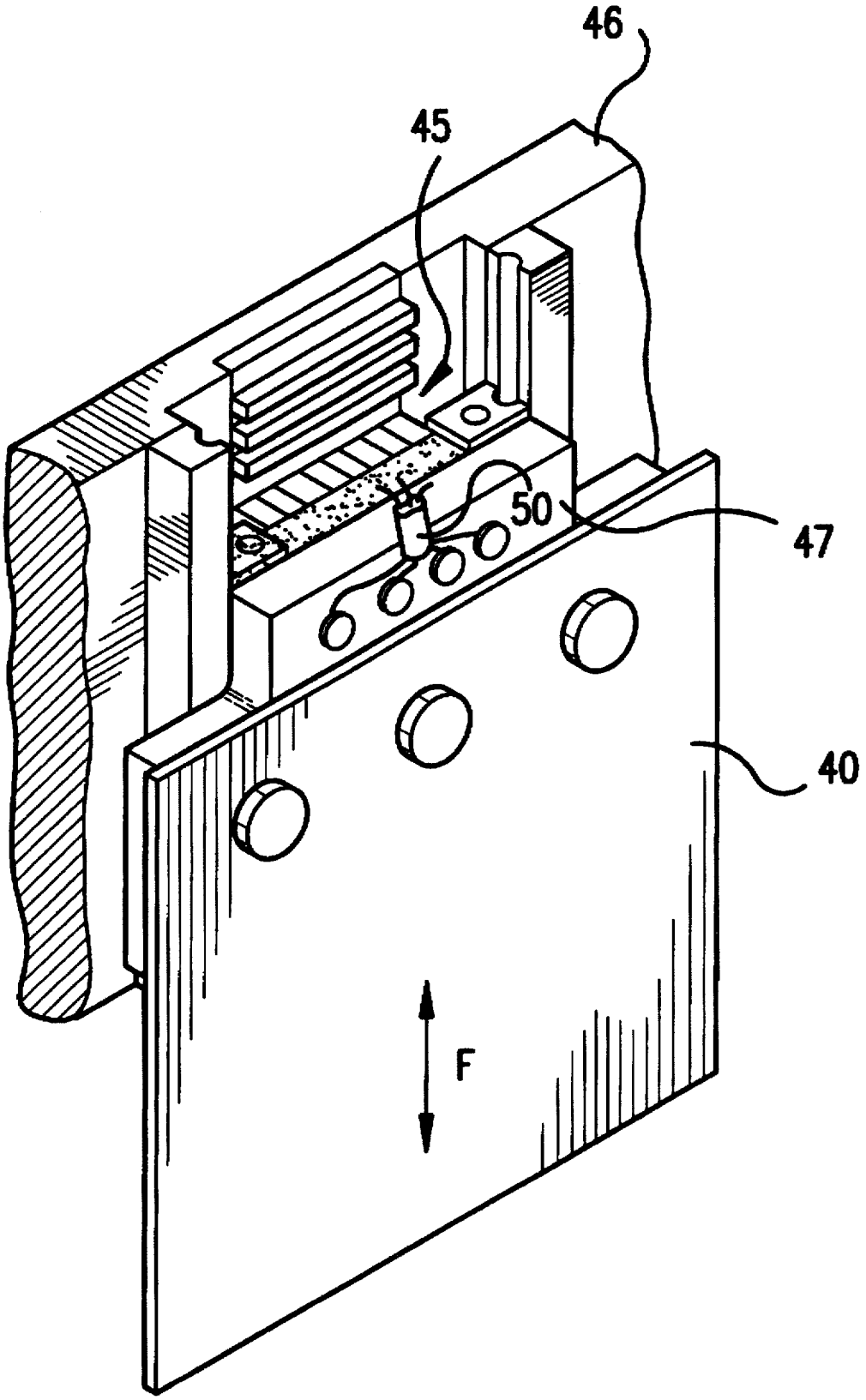
FIG. 8 is an enlarged perspective view showing one of the fall plates shown in FIG. 7.

FIG. 8 shows one of the fall plate driving sources described in the above paragraph. The numeral 45 denotes a linear pulse motor; 46 denotes a holding member; 47 denotes a movable body; and 40 denotes a divisional fall plate. When a signal current is passed through lead wire 50, the movable body 47 lowers in the direction of arrow to allow the fall plate 40 fixed thereto to lower to perform the fall plate action; thereafter it is raised by passing signal current.

As described above, according to the present invention, in displacing a movable body at least a portion of which constitutes a guide point or at least portions of which constitute a guide point and a fall plate on the basis of driving means, it can be quickly displaced by the action of auxiliary drive means; therefore, even if the rotative speed increases, the movement of the movable body can follow such speed, making it possible to attain a high efficiency of knitting.

Further, in the case of displacing the movable body by a pulse signal, the arrangement for ensuring that it takes place somewhere between adjacent knitting needles without fail prevents needle breakage and yarn breakage, thus precluding the danger of causing serious damage to the knitting components.

Further, knitting is made possible for two or more knitting gauges; thus, warp knits having different gauges and different patterns can be obtained on a single knitting machine.

In a warp knitting machine having a fall plate, the fall plate can be actuated to act in each knitting width or partially in one knitting width. Furthermore, since selective action is possible in suitable courses, the fall plate action is effected for the pattern arrangement of a partial float pattern in the knitting course direction and/or the knitting width direction and hence the action of the fall plate takes place in necessary places alone, with the result that vibration is mitigated and noise decreases as no large-scale device is required.

What is claimed is:

1. An auxiliary driving device for the patterning device for a warp knitting machine, including a desired number of movable bodies each having at least a portion thereof formed as a guide point, said movable bodies being disposed in a guide path so that each of said movable bodies are movable on the basis of driving means directly or associatively installed thereon, patterning being effected in that the respective guide points are moved by desired amounts of displacement in desired directions on the basis of signals transmitted from an electronic control section to the driving means for the individual movable bodies and are thereby positioned, said auxiliary driving device is characterized in that auxiliary driving means is attached which adds to the driving force from the driving means during start and movement involved in the lapping by the movable bodies.

2. An auxiliary driving device as set forth in claim 1, wherein said auxiliary driving means comprises the blowing of compressed air from a nozzle provided in a portion of the movable body.

3. An auxiliary driving device as set forth in claim 1, wherein said auxiliary driving means comprising the blowing of compressed air from a nozzle directed to the movable body.

4. An auxiliary driving device as set forth in claim 1, wherein said auxiliary driving means is of magnetic arrangement.

5. An auxiliary driving device as set forth in claim 1, wherein said magnetic arrangement utilizes the stator and the movable body of a linear motor.

6. An auxiliary driving device as set forth in claim 4, wherein said magnetic arrangement utilizes the attraction and/or repellence of the iron core constituting an electromagnet.

7. An auxiliary driving device as set forth in claim 1, wherein the auxiliary driving means utilizes displacement caused by a piezoelectric element.

8. A method of drive-controlling a pulse motor in a controlling method for displacing a movable body by pulse signals in a patterning device the method comprising setting the amount of stepping movement of a pulse motor in such a manner as to ensure that a front end of a guide point in the movable body to be moved by transmitted pulses is positioned between adjacent knitting needles.

9. A method of controlling the movable body in the patterning device of claim 8, further comprising providing two or more knitting machine gauges and setting the amounts of displacement for the individual movable bodies with the individual knitting gauge pitches used as criteria.

10. A method of controlling the movable body as set forth in claim 9, further comprising displacing the movable bodies on the basis of pulse signals corresponding to the amounts of stepping movement of the individual movable bodies matching the individual knitting gauge pitches.

* * * * *